United States Patent [19]

Dumortier

[11] Patent Number: 4,627,249

[45] Date of Patent: Dec. 9, 1986

[54] LATCH FOR UTILITY ACCESS DOOR

[76] Inventor: Robert Dumortier, 9 rue Duchartre, 34500 Beziers (Herault), France

[21] Appl. No.: 775,079

[22] Filed: Sep. 12, 1985

[30] Foreign Application Priority Data

Sep. 12, 1984 [FR] France ..... 84 14229

[51] Int. Cl.[4] ..... E05B 65/06

[52] U.S. Cl. ..... 70/139; 292/204; 70/465

[58] Field of Search ..... 70/139, 135, 136, 137, 70/138, 158, 159, 160, 161, 403, 404, 465; 292/204, 103, 307, 256.5, DIG. 57

[56] References Cited

U.S. PATENT DOCUMENTS

| | | | |
|---|---|---|---|
| 1,163,838 | 12/1915 | Maul | 292/204 |
| 1,263,104 | 4/1918 | Phelps | 70/404 |
| 1,604,330 | 10/1926 | Witkowski | 292/204 |
| 1,878,436 | 9/1932 | Burroughs | 70/465 |
| 4,270,780 | 6/1981 | Bernard | 70/139 |

FOREIGN PATENT DOCUMENTS

| | | | |
|---|---|---|---|
| 84422 | 10/1957 | Denmark | 70/139 |
| 87587 | 4/1956 | Norway | 292/204 |
| 208864 | 1/1924 | United Kingdom | 292/204 |

*Primary Examiner*—Robert L. Wolfe

*Attorney, Agent, or Firm*—Karl F. Ross; Herbert Dubno

[57] ABSTRACT

A latch has spaced inner and outer plates formed with respective coaxial bores. The outer plate is formed at its bore with at least one notch and the inner plate is formed adjacent its bore with at least two angularly offset and axially extending cutouts. A plug extending through the bores and rotatable therein about the axis has an outer head in the outer bore and accessible from outside the plates and an opposite inner end exposed inward past the inner plate. A locking dog extends radially from the plug in the space between the plates. An inner abutment washer is secured to the inner end of the plug and spaced axially inward of the inner plate and a retaining washer angularly nondisplaceable on the inner end of the plug has a bump engageable in the cutouts of the inner plate. A compression spring braced between the washers urges the bump into the cutouts. A key engageable with the plug head has a radial tab complementary with the notch of the outer plate. The plug with the pawl and retaining washer are angularly displaceable about the axis between a locking position in which the tab and notch can interfit and the bump of the retaining washer engages one of the cutouts of the inner plate and a freeing position in which the tab and notch cannot interfit and the bump of the retaining washer engages the other cutout of the inner plate. A formation on the inner end of the plug is shaped to be engaged for rotation of the plug from inside the inner plate.

5 Claims, 2 Drawing Figures

LATCH FOR UTILITY ACCESS DOOR

FIELD OF THE INVENTION

The present invention relates to a latch for a utility access door. More particularly this invention concerns such a latch used on an outside manhole cover set in a street, sidewalk, or the like.

BACKGROUND OF THE INVENTION

As described in French Pat. No. 2,376,919, a manhole-cover latch comprises a lock plug that is recessed in the cover or hatch with its head exposed to the outside and its inside portion carrying a locking pawl or dog. This plug can be pivoted between a locking position with the pawl preventing the cover from being opened and a freeing position permitting such opening. In the locking position formations on the latch plug align with formations on the respective cover to allow a key to fit over the plug, and in the freeing position further formations prevent the key from being retracted, so that the cover must be locked before the key can be withdrawn.

Such an arrangement works relatively well when the manufacturing tolerances for the various parts are quite tight. When, as is common, the cover and its associated parts are somewhat crudely constructed, or when they have suffered some mechanical damage, the latch frequently becomes fully nonoperational.

In addition these devices can only be operated from the outside. Thus it is impossible for a man working in a utility duct to exit through a cover that has not been opened in advance from the outside.

OBJECTS OF THE INVENTION

It is therefore an object of the present invention to provide an improved latch for a utility access cover.

Another object is the provision of such a latch for a utility access cover which overcomes the above-given disadvantages, that is which will operate even if produced to sloppy manufacturing tolerances or if its associated parts are somewhat damaged or deformed.

A further object is to provide such a latch which can be operated from both sides of the cover or hatch.

SUMMARY OF THE INVENTION

A latch assembly according to this invention has relatively fixed and fixed inner and outer plates defining a space and formed with respective inner and outer bores aligned along a common axis. The outer plate is formed at its bore with at least one radially extending formation and the inner plate is formed adjacent its bore with at least two angularly offset and axially extending formations. A plug extending through the bores and rotatable therein about the axis has an outer head in the outer bore and accessible from outside the plates and an opposite inner end exposed inward past the inner plate. A locking dog extends radially from and is angularly fixed to the plug in the space between the plates. An inner abutment washer is secured to the inner end of the plug and spaced axially inward of the inner plate and a retaining washer angularly nondisplaceable on the inner end of the plug has an axially extending formation engageable with the formations of the inner plate. A compression spring braced between the washers urges the formation of the retaining washer axially outward toward the inner plate. A key engageable with the plug head has an axially extending formation complementary with the formations of the outer plate. The plug with the pawl and retaining washer are angularly displaceable about the axis between a locking position in which the formations of the key and outer bore can interfit and the formation of the retaining washer engages one of the formations of the inner plate and a freeing position in which the formations of the key and outer bore cannot interfit and the formation of the retaining washer engages the other of the formations of the inner plate. A formation on the inner end of the plug is shaped to be engaged for rotation of the plug from inside the inner plate.

This system therefore allows the parts to have some play while still working. The radially projecting pawl can fit fairly loosely in the element being arrested so that even if the parts are damaged, the latch will work.

According to another feature of this invention there is a washer with a low coefficient of friction engaged between the pawl and the inner plate. Similarly the retaining washer is made of a material with a low coefficient of friction.

In addition in accordance with this invention the head is of an outside diameter smaller than the inside diameter of the outer bore and the key has a sleeve engageable over the head and inside the outer bore. The key and sleeve have formations that radially interengage and rotationally couple them together when fitted together and the sleeve has an inner end formed with at least one radially outwardly projecting tab, in which case the formation of the outer plate is an axially throughgoing notch complementary to the tab and an angularly extending groove also complementary to the tab. The tab engages in the notch and one end of the groove in the locked position and in the opposite end of the groove in the freeing position. Furthermore the groove is only open axially and radially inward and is formed at its opposite end with an axially inwardly open blind notch in which the tab is received in the freeing position.

DESCRIPTION OF THE DRAWING

The above and other features and advantages will become more readily apparent from the following, reference being made to the accompanying drawing in which.

SPECIFIC DESCRIPTION

Figure 1:
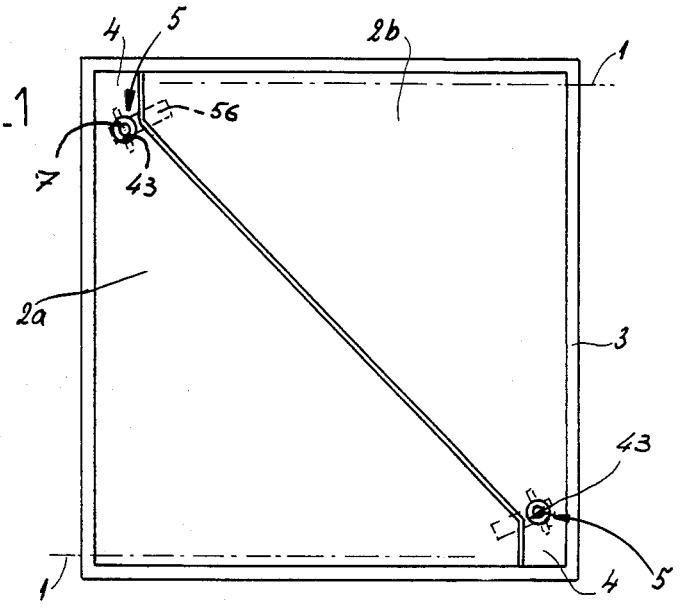
FIG. 1 is a small-scale top view of a utility access cover equipped with the latch according to this invention.

As seen in FIG. 1 an access cover has a pair of identical cover halves 2*a* and 2*b* pivotal about respective parallel axes 1 inside the opposite edges of a frame 3 that is normally set into a sidewalk, wall, street, or the like. Each of the cover halves 2*a* and 2*b* is mainly of right-trapezoidal shape with an extension 4 at its edge opposite its axis 1. Latches 5 are provided in these extensions 4 that can prevent the respective cover halves 2*a* and 2*b* from being lifted. For access to the equipment the latches 5 are released and the two cover halves 2*a* and 2*b* are pivoted away from each other.

Figure 2:
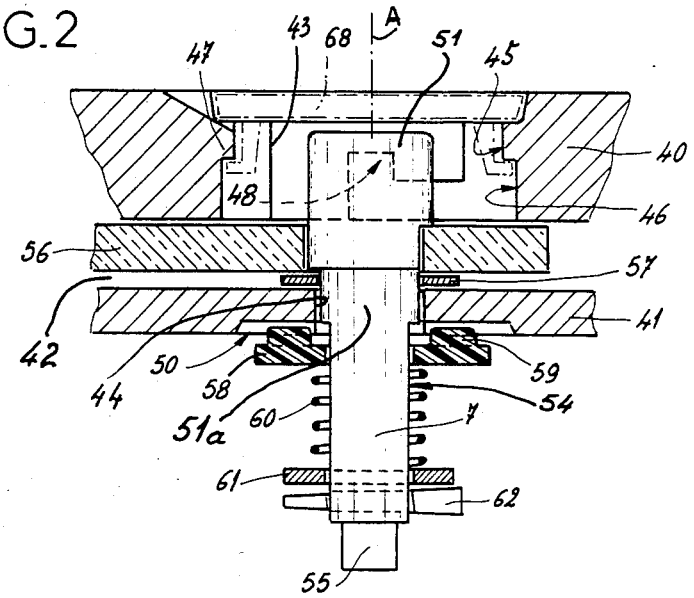
FIG. 2 is a large-scale axial section through the latch in accordance with the invention.

As best seen in FIG. 2 each cover 2*a* or 2*b* is double-walled at least at the respective latch 5, having a thick outer plate 40 and a thinner inner plate 41 defining a space 42 open toward the other cover 2*b* or 2*a*. The thick outer plate 40 is formed with a large-diameter and cylindrical outer bore 43 and the thinner inner plate with a small-diameter and cylindrical inner bore 44, both centered on an axis A perpendicular to the plates 40 and 41.

The outer bore 43 is formed with two diametrally opposed and axially extending and throughgoing square-section notches 45 from which respective grooves 46 extend angularly through 90°, terminating at inwardly open blind notches 48. The notches 46 are formed with small shoulders 47 that allow an elastic cap 68 to be fitted over the bore 43 to seal the latch assembly, preventing dirt and the like from entering it. Thus these inwardly open blind notches 48 are diametrally offset from each other and the notches 45 and 48 are angularly equispaced about the axis A. The inner plate 41 has an inner face 49 formed at the respective bore 44 with four angularly .quispaced, radially inwardly, and axially inwardly open notches 50 that are and axially aligned with the respective notches 45 and 48 of the outer plate 40.

Figure 4:
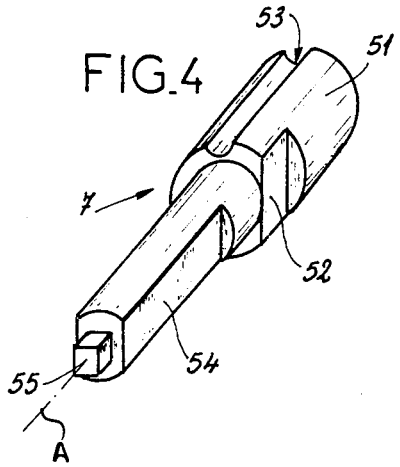

The latch 5 includes a plug 7 best seen in FIGS. 2 and 4 and basically comprising a cylindrical head 51 of a diameter smaller than that of the bore 43 but greater than that of the bore 44 and a cylindrical stem 51*a* of a diameter slightly smaller than that of the bore 44. The head 51, which is centered on the axis A and of larger diameter than the bore 44, is formed with an axially throughgoing semicylindrical notch 53 that is open radially outward and with a secantal flat 52 that is level with the space 42. A locking pawl or dog 56 normally made of a durable synthetic resin has a flatted bore so that it can fit over the head 51 at the flat 52 so as to be rotationally coupled to the plug 7, and a teflon washer 57 is provided between the pawl 56 and the outer surface of the inner plate 41.

Figure 5:
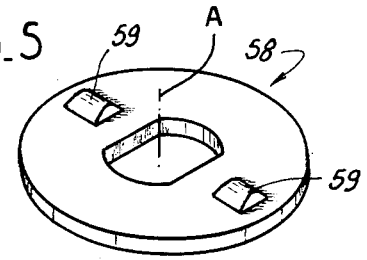
Figure 6:
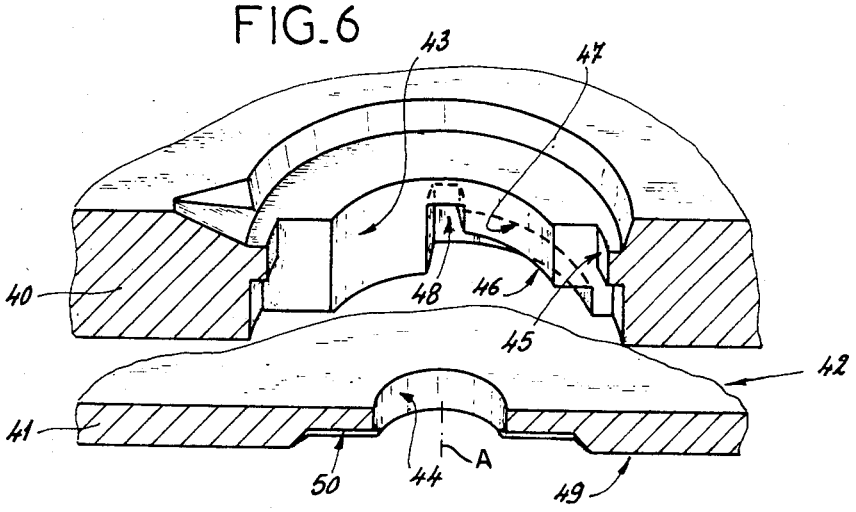
FIG. 6 is an axially sectional and partly perspective view of a detail of the cover.

The stem 51*a* of the plug 7 is formed with two diametrally opposite flats 54 so the it can be fitted with a retaining washer 58 shown in FIG. 5 and provided with two diametrally opposite bumps 59 that can fit complementarily in the notches or grooves 50. A compression spring 60 engaged around the stem 51*a* bears outward on this washer 58 and inward on another washer 61 secured by a key or wedge 62 to the inner end of the stem 51*a*. Thus the washer 58 is urged axially outward against the inner face of the plate 41, simultaneously pulling the head 51 axially inward to compress the washer 57 between the pawl 56 and the outer surface of the inner plate 41.

The inner end of the stem 51*a* is formed with a faceted projection 55, here of square section, so that the plug 7 can be turned from the inside of the respective cover 2*a* or 2*b*.

It is possible to rotate the plug 7 and the pawl 56 about the axis A between the locking position in which as seen in FIG. 1 the pawl 56 projects into the space 42 of the adjacent cover 2*a* or 2*b*, thereby preventing upward pivoting of the cover 2*a* or 2*b* carrying the latch 5, or a freeing position clear of the other cover and allowing such pivoting. This rotation can be effected from inside the cover by applying any appropriate tool, such as a small socket wrench, to the formation 55 and twisting the plug 7.

Figure 3:
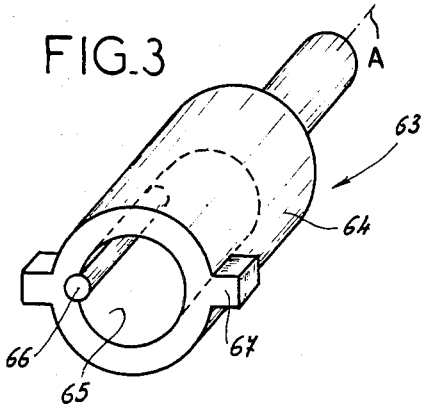
FIGS. 3, 4, and 5 are perspective views respectively of the latch-operating key, the latch plug, and the retaining washer.

From outside it is necessary to use a key 63 shown in FIG. 3. This key 63 is basically a cylindrical sleeve 64 of an internal diameter slightly greater than the outside diameter of the head 51 and an outside diameter slightly less than inside diameter of the bore 43. In addition this sleeve 64 is formed internally with a radially inwardly projecting semicylindrical ridge formation that can fit complementarily with the outwardly open groove formation 53 of the head 51, allowing the key 63 to fit over and be rotationally coupled to the head 51. In addition the inner end of the sleeve 64 of the key 63 is provided with two radially outwardly projecting square section tabs 67 shaped to fit complementarily in the notches 45 and arranged to fit with these notches 45 when the latch is locked and the formations 53 and 66 are aligned.

Thus to open the latch 5 the key 63 is fitted over the head 51, with the tabs 67 fitting through the notched 45 and entering the ends of the angular grooves 46. The key 63 is then turned through 90° to bring the tabs 67 into alignment with the notches 48 and simultaneously move the dog 56 into the freeing position. In this position the key 63 cannot be removed from the latch 5 since the notches 48 open only inward, so that the user will be unable to recuperate his key 63 without locking the latch. In both the freeing and locking positions the bumps 59 of the retaining washer 58 hold the plug 7 against rotation so that vibration or the like will not open or close the latch.

To relock the latch 5 the key 63 is turned in the reverse direction through 90°, the key 63 being pushed axially inward somewhat if necessary to push the formations 67 out of the notches 48 which extend axially outward somewhat past the grooves 46. Once the latch is locked the key 63 can be withdrawn.

I claim:

1. A latch assembly comprising:

relatively fixed and fixed inner and outer plates defining a space and formed with respective inner and outer bores aligned along a common axis, the outer plate being formed at its bore with at least one radially extending formation and the inner plate being formed adjacent its bore with at least two angularly offset and axially extending formations;

a plug extending through the bores and rotatable therein about the axis, the plug having an outer head in the outer bore and accessible from outside the plates and an opposite inner end exposed inward past the inner plate;

a locking dog extending radially from and angularly fixed to the plug in the space between the plates;

an inner abutment washer secured to the inner end of the plug and spaced axially inward of the inner plate;

a retaining washer angularly nondisplaceable on the inner end of the plug having an axially extending formation engageable with the formations of the inner plate;

a compression spring braced between the washers and urging the formation of the retaining washer axially outward toward the inner plate;

a key engageable with the plug head and having an axially extending formation complementary with the formations of the outer plate, the plug with the pawl and retaining washer being angularly displaceable about the axis between a locking position in which the formations of the key and outer bore can interfit and the formation of the retaining washer engages one of the formations of the inner plate and a freeing position in which the formations of the key and outer bore cannot interfit and the formation of the retaining washer engages the other of the formations of the inner plate; and a formation on the inner end of the plug adapted to be engaged for rotation of the plug from inside the inner plate.

2. The latch assembly defined in claim 1, further comprising a washer with a low coefficient of friction engaged between the pawl and the inner plate.

3. The latch assembly defined in claim 1 wherein the retaining washer is made of a material with a low coefficient of friction.

4. The latch assembly defined in claim 1 wherein the head is of an outside diameter smaller than the inside diameter of the outer bore and the key has a sleeve engageable over the head and inside the outer bore, the key and sleeve being formed with formations that radially interengage and rotationally couple them together when fitted together, the sleeve further having an inner end formed with at least one radially outwardly projecting tab, the formation of the outer plate being an axially throughgoing notch complementary to the tab and an angularly extending groove also complementary to the tab, the tab engaging in the notch and one end of the groove in the locked position and in the opposite end of the groove in the freeing position.

5. The latch assembly defined in claim 4 wherein the groove is only open axially and radially inward and is formed at its opposite end with an axially inwardly open blind notch in which the tab is received in the freeing position.

* * * * *